United States Patent [19]

Daniels et al.

[11] 4,320,696

[45] Mar. 23, 1982

[54] AIR OUTLET

[76] Inventor: Klaus Daniels, Carusoweg 3a, 8000 Munich 71, Rüdiger Detzer, Muhlweg, 78, 6301 Alten Buseck, both of Fed. Rep. of Germany, Josef Brühlmeier, Hintere Hohenstrasse 6, CH 54330 Wettingen, Switzerland

[21] Appl. No.: 7,384

[22] Filed: Jan. 29, 1979

[30] Foreign Application Priority Data

Feb. 3, 1978 [DE] Fed. Rep. of Germany ..... 2804670

[51] Int. Cl.[3] ..... F24F 7/00

[52] U.S. Cl. ..... 98/41 AV; 98/40 VT; 98/40 R; 251/63; 251/63.6

[58] Field of Search ..... 98/40 D, 40 E, 40 VT, 98/41 AV, 40 B, 40 R; 251/63, 63.4, 63.6

[56] References Cited

U.S. PATENT DOCUMENTS 2,712,428 7/1955 Forwald ..... 251/63
2,848,936 8/1958 Vallero ..... 98/40 B
3,020,819 2/1962 Kunen ..... 98/40 B
3,799,046 3/1974 Gorchev ..... 98/41 AV

FOREIGN PATENT DOCUMENTS 225410 12/1968 U.S.S.R. ..... 98/40 R

*Primary Examiner*—Albert J. Makay
*Assistant Examiner*—Henry Bennett
*Attorney, Agent, or Firm*—Fulwider, Patton, Rieber, Lee & Utecht

[57] ABSTRACT

An air blowing outlet for air-conditioning systems has an inner ball able to be moved towards and away from a ball seat in a middle opening in a valve plate for controlling the rate of air outlet through this opening.

In addition it is possible for the air direction to be radial.

To this end the valve plate is able to be moved axially clear of the outlet, this opening a ring gap between it and the outlet. The plate is moved by the ball pushing against it, that is to say with the middle opening shut.

19 Claims, 7 Drawing Figures

AIR OUTLET

BACKGROUND OF THE INVENTION (1) Field of the Invention

The invention relates to an air outlet with a blowing mouthpiece, which at its opening is able to be shut by a valve plate running normal to its axis and able to be moved in the direction of the axis and whose edge is used with the opening in forming an adjustable ring-space, and with a nozzle opening, placed in the valve plate and running generally in the direction of the axis and which has a valve seat and which is able to be shut in a shutting position by a valve body placed to the inner side of the valve plate. Such an air outlet is used for air-conditioning systems for rooms and is normally placed in the ceiling of a room with the blowing mouthpiece pointing downwards and is joined with the fresh and cold air piping of an air-conditioning system; in some cases the air outlet of the invention may furthermore be placed in side walls, floors or in structures such as the backrests of seating in ships, airplanes, trains and the like.

(2) Earlier constructions

In one earlier suggestion (see British Pat. No. 742,236), an overhead ceiling air outlet was to have a disc-like opening in an air pipe or duct and a ring in the duct able to be screwed upwards and downwards in the axial direction. A ball, able to be turned in all directions, was supported in a ring with an inner ball-like face. This ball had a number of holes whose axes were parallel to each other and furthermore had a horizontal outer flange, forming, with the edge of the disc-like opening, a ring-like air outlet, which, on screwing the ring upwards was firstly shut off more and more and then, lastly, shut completely. The holes in the ball were furthermore able to be placed at different blowing angles and, more specially, normal to the direction of blowing from the ring-like air outlet. By the necessary turning of the ball, the air outlet was able to be shut down completely. It was furthermore possible to have blowing of the air into the room only through the ring-like outlet in a generally horizontal direction. It was furthermore possible for the blowing of air through the holes in the ball to be generally limited to a vertical direction and furthermore, at the same time, through the two outlets. However, with this system it was not possible to make any great change in the rate of air coming out through the holes without, at the same time, changing the direction of the air jet; this was more specially true for generally vertical directions of blowing. Furthermore, all changes in the outlet air from the old air outlet had to be undertaken by hand adjustment; furthermore, because the ball was able to be moved in all directions, it was not possible to have mechanical control without making the structure overcomplex.

OUTLINE OF THE INVENTION

Taking this earlier suggestion as a starting point, one purpose of the invention is that of making such a further development of an air outlet of the sort noted that it is not only the air coming out radially, but furthermore that coming out axially in relation to the outlet mouthpiece which may undergo ready adjustment between the greatest rate and complete shut-off by means of a control driving system, without the jet direction being changed.

This purpose is effected by the invention in that the valve body is able to be moved, for opening the nozzle opening, in the direction of the axis away from the valve seat out of its shut-off position. So, for opening the nozzle opening, it is no longer necessary to make use of a turning motion of the valve body about one of its axes, so that it is furthermore not necessary to make use of air guiding structures of the valve body for forcing a change in the outlet direction, when the valve body undergoes adjustment motion.

As a general teaching of the invention, it is possible for the valve body to be moved further from the air outlet into the room, this being specially useful, because the air outlet design is specially flat; in accordance with one form of the invention, it is, however, useful for the valve seat to be placed on the side, facing the blowing mouthpiece, of the valve body and for the valve body to be able to be moved towards the blowing mouthpiece, because in this case the blowing of air may take place towards the valve opening in the axial direction into a room without the air jet, after coming out of the valve opening, running up against the valve body, able to be moved in the axis-direction, and being changed in direction by it.

As a further general teaching of the invention, it is possible for the valve body to have air guide ducts running through it, opening, for example, at the valve seat and, for this reason, being shut by the valve body when it is in its shut position. However, for not having any losses of moving air and for effecting a specially simple, low-price design, it is preferred for the valve body only to be designed as a displacement body, which, for its part, has no duct system designed for guiding the air on blowing out.

The valve body may, for example, be cone-like, in which case, in the shut position, it may be supported on a cone-like seat; in accordance with one form of the invention, it is, however, specially useful for the valve body to be outwardly curved, because such a design generally makes it less necessary for the placing of the valve body in relation to its valve seat to be exact, so that in a low-price design of the air outlet generally great production tolerances are possible.

Furthermore, in the case of a outwardly curved design of the valve body, it is not completely necessary for the valve seat of the body to be of the same design and in some cases it is specially useful for the valve seat for its parts, in cross-section to have a straight outline or an outline curving away from the outline of the outwardly curved valve body; in this case, if a high-level seating effect of the valve body is not possible, between its face and the face of the valve seat, a narrow, nozzle-like duct is produced, in which there will only be loss or leaking of air at a small rate and a high speed, the outcome being a dynamic vacuum produced by the air, which, together with the inner pressure in the air-conditioning system, is responsible for a further forcing into position of the valve body, so that the leaking air is decreased to the least possible amount, even though production tolerances are great.

In a further form of the invention, it is specially useful, for balancing tolerances produced on putting the system together, for the valve body to be a cone, such a body, with the smallest possible face or area, and, for this reason, producing generally speaking low edge zone friction with respect to the air moving past, having within it the greatest possible size of inner space, which may be used for taking up servo systems.

In accordance with a further, alternative design, in cases in which high air rates have to be processed with the lowest possible losses, it is, however, more specially useful for the valve body to have the form of a drop or any other form which is streamlined, in the case of which, on the one hand, there is no face normal to the direction of motion for the air to be stopped by and, on the other hand, in the direction of motion the valve body may be so formed that detachment vortices are not produced. The last-named development of the invention is more specially useful, because in the case of a high air throughput, the dynamic forces on the valve body produced by the air moving past, and which are to be taken up by an adjustment system, are decreased to the least possible value.

One generally simple way of making the valve body is that of casting, pressing or forging it as a solid part and then, if necessary, truing it up by machining. In one form of the invention, it is, however, more specially useful for the valve body to be in the form of a hollow ball, this being so, not only for the reason noted earlier for making use of a space in the valve body, but furthermore, because of the decrease in mass of the valve body so produced, so that, only generally speaking low adjustment forces are necessary for an adjustment system and furthermore oscillation forces, which might be the outcome of air running up against the valve body off-center, are kept so low by a low weight of the oscillating masses that the oscillation forces are not damaging and furthermore are not the cause of noise trouble, or may be damped readily. In this respect for damping it is possible for example for the casing of the hollow ball to be made of a giving material with a high hysteresis of deformation, so that any tendency to oscillation is stopped at the very start.

Because for controlling the air jet coming from the nozzle opening, the valve body only has to be turned in a single direction, it is specially useful, in comparison with old designs of valve bodies able to be moved with three degrees of freedom, for the valve body of the invention to have its own servo-motor, which is only to have a limited straight-line range of motion and so is not only simple and low-price in design, but may furthermore be placed even spaced from the air outlet at any position offering itself from the design point of view and without any very complex structure being needed for force-connection, because the valve body may readily be moved by such a connection in the form of pulling-cords or push-rods.

It is a general teaching of the invention that not only the valve plate but furthermore the valve body may have its separate servo-motor; this form of design is more specially useful where, generally speaking, low air rates are to be used for air-conditioning, for example in airplanes with specially good effect or firstly a specially high level of air circulation and then a specially low degree of air motion is necessary, as is the case for example in rooms for surgical operations.

In accordance with a further development of the invention, it is, however, specially useful for the valve body and the nozzle plate to be moved by one servo-motor dependent on each other and in this respect it is again specially useful for firstly one of the two parts to be moved as far as an end position and then for example using this part and an end-stop, the second of the two parts for its part undertakes a full positioning motion; in this case, using only one single servo-motor in a specially low-price and simple system, the desired adjustment of the air outlet is made possible, in which respect any control system present is only needed for automatic control of a single control amount, that is to say the overall adjustment range of the servo-motor.

As noted earlier, the servo-motor may be supported on the blowing mouthpiece and designed for driving the valve body by way of a push-rod; if, however, because of small servo-forces, a small size of the servo-motor is possible, it is of specially good effect for the servo-motor to be joined with, or supported by, a push-rod on the blowing mouthpiece and for the housing of the servo-motor, or the servo-motor itself, to be joined with the valve body. So in this case the servo-motor is, in a preferred form of the invention, placed inside the opening of the blowing mouthpiece, where, after taking off the valve plate, it may readily be got at for servicing operations or for adjustment; so, in this case it is possible for the air outlet of the invention to be fixedly placed in a wall, because all parts may be got at from the outlet side.

As noted earlier, it is, in a further development of the invention, of specially good effect for the housing of the servo-motor to be designed forming at least part of the valve body, so that the servo-motor, although placed inside the blowing mouthpiece, is not something in addition in the way of the air moving through the structure.

Furthermore it is possible to do without a mechanical connection system or the like between the servo-motor and the valve body, so that the design of the invention is very light in weight and, for this reason, only generally speaking low driving forces are necessary for the servo-motor, something which, in turn, makes for a decrease in weight. If the valve body is only to be moved between two limiting or end positions, it is of specially good effect in a further design of the invention for the servo-motor to be in the form of a driving magnet or solenoid, which, for example, may have an outwardly curved winding placed in a housing and able to be moved along a guide rod taking the form of an armature.

More specially where exact positioning-control of the valve body is necessary, it is of specially good effect, in a further development of the invention, for the servo-motor to take the form of an electric motor, in which case, in the case of great driving distances and a low exactness of adjustment, it is possible to make use of a linear motor, while in the case of small driving distances it is best to make use of a geared motor.

Inasmuch as adjustment of the valve body only makes a linear axial motion necessary, it is a further useful point of the invention that a servo-motor with a driving air or liquid-powered piston may be used, or use may be made of an air or liquid-powered bellows structure; in order to make certain that any leakage of driving liquid from the hydraulic system does not get into the moving fresh air for air-conditioning, it is more specially useful in this connection in one form of the invention for an air-powered servo-motor to be used, which is best powered with fresh air and may be designed so as to have a generally high rate of air loss, so that in general purpose use there will be no sealing troubles.

For the input of driving power to the servo-motor, it is of specially good effect to make use of the push-rod, because it is placed so as not to be moved in relation to the unmoving parts of the air outlet. It is, for example, possible for the push-rod to be designed as the stator, having current running through it, of a linear motor or electromagnet, in which respect the part of the servo-motor used for the valve body, only has a shorted winding and/or a metal ring. It is specially on using an air-powered motor that the use of a hollow rod as an input compressed air line is a specially low-price and well thought-out system, more specially because there will be no sealing troubles inasmuch as compressed air may readily be let off into the moving fresh air.

In order to make possible a specially simple driving system of good effect joining the valve body and the nozzle plate, the valve body and/or the nozzle plate have positioning parts for limiting the distance between them, so that, more specially, using the servo-motor, which in the invention is best in the valve body, the nozzle plate may undergo adjustment even if the connection with the other parts is adjustable.

In a specially simple form of the invention, the nozzle plate with the connection parts and springs is joined with a cross-piece in the blowing mouthpiece and the springs are designed for moving the nozzle plate automatically back into its starting position, this being more specially the shut position. It is, however, only necessary to have one joining part, acting in one direction, between the valve plate and the valve body; if the valve body is placed on the side, facing the blowing mouthpiece, of the valve plate, it is then possible, using the springs, for the nozzle opening in the valve plate to be shut off, if necessary, an opening motion of the servo-motor taking place opposite to the spring force. If, for example, on using an air-powered servo-motor the inlet pipe for the driving air is damaged or if the complete control system is turned off, it is then possible, if necessary, for the air outlet to be automatically shut down by the effect of the springs, so that when the overall system is in a damaged condition or has been shut down, there will be no exchange of air (which would be very undesirable) between the rooms joined with the air-conditioning system, for example, in a hospital.

It is of good effect in a further development of the invention, in addition to, or in place of, the spring for the guide parts of the nozzle plate to be joined to a second servo-motor in order, as noted earlier, to have more complete adjustment and positioning of the air outlet.

In the invention the guide parts are best so designed that they are responsible for a straight-line motion of the valve plate, so that the valve plate may furthermore have sloping nozzle openings without, for this reason, the direction of the air coming from the nozzle opening being changed on adjustment in position of the valve plate.

So, in a further development of the invention, it becomes possible for the nozzle to have a unit for producing a twisting motion in the outlet air at the ring space or at the nozzle opening, inasmuch as, because of the straight-line adjustment positioning of the valve plate and of the valve body, even on undertaking an adjustment motion, the twisting motion of the outlet air is not decreased or stopped by a further turning motion.

Because for controlling the position of the valve body only one controlling value is necessary, as detailed earlier on, it is specially useful and of good effect for the servo-motor to have its own thermostat or other measuring sensing unit acted upon by the room temperature or any other condition of the air in the room and which after comparison with a desired value may be used outright for changing the adjustment of the control system and, for this reason, for driving the servo-motor.

LIST OF FIGURES

An account will now be given of some working examples of the invention using the diagrammatic drawings in more detail:

FIGS. 1*a*, 1*b* and 1*c* are views of a ceiling air outlet in vertical section and in different operation positions, as a first example of the invention.

ACCOUNT OF WORKING EXAMPLES OF THE INVENTION

Figure 1A:
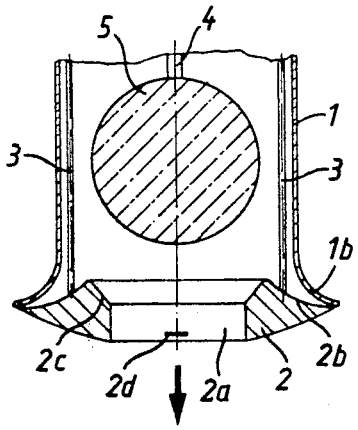

Under the air outlet pipe 1 made wider in the form of a funnel 1*b* of the airoutlet side, there is a nozzle plate 2, having a middle opening 2*a* and supported by rods 3. The nozzle plate has its outer edge 2*b* made with the same curved form as that of the funnel edge 1*b*. A ball 5, dependent on the rod 4, is placed in the middle of the pipe 1 and its curved form is the same as that of the top edge or seat 2*c* of the opening 2*a*. The ball is used on the one hand as an air controller and on the other hand as a valve ball for the valve seat 2*c*.

A stop 2*d*, able to undergo adjustment in height, is present for the ball 5 and is placed in the middle of the opening 2*a*.

In FIG. 1*a*, air outlet is only axial. The valve ball 5 has, in its top position, completely cleared or freed the middle opening 2*a*. The radial space or gap between the funnel wall 1*b* and the edge 2*b* of the nozzle plate is shut.

So blowing of all air takes place vertically. This position is normally used for heating air.

The position of FIG. 1*a* may be used for cooling as well, if the motion of the cooling air towards the user or towards the space near him is to be quicker for having a sort of air shower effect.

Figure 1B:
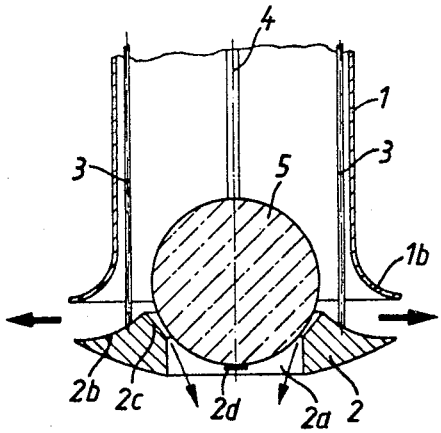
Figure 2:
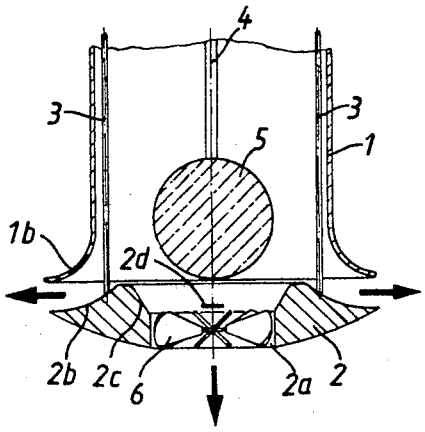
FIG. 2 is a view of an air outlet on the same lines as that viewed in FIGS. 1*a* to 1*c*, but with twister blades, as a second working example of the invention.

As will be seen from FIG. 2, twister blades 6 may be placed, fixedly or with slope adjustment, in the opening 2*a* for changing air distribution, that is to say air direction, into the room or space. By lowering ball 5 as far as stop 2*d* in opening 2*a*, the space between valve ball 5 and valve seat 2*c* is decreased to the smallest value of shut off completely. Then, on further lowering, the ball 5 will have the effect of moving the nozzle plate 2 with it, so that the radial nozzle between the edge 2*b* and the funnel wall 1*b* will be opened (FIG. 1*b*) to a degree keeping in step with downward motion of the ball. It is then possible for air outlet to take place equally to a small degree axially and, at the same time, radially, while, however, when opening 2*a* is closed, outlet will only be radial.

Figure 1C:
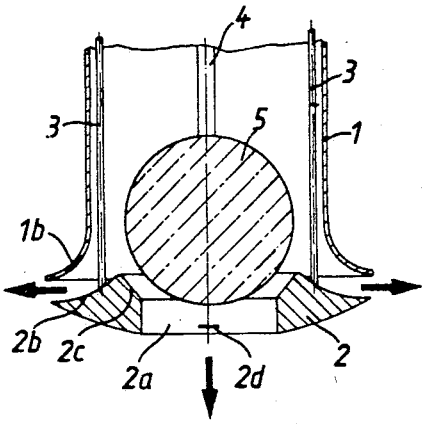

The positions to be seen in FIGS. 1*a* and 1*b* are produced by adjustment or control of the ball 5, so that for this purpose only one servo-motor is needed. If the space between the valve ball 5 and the valve seat 2*c* is to be made larger when the radial nozzle is opened, a second servo-motor will be necessary, by which, using the rods 3, only the nozzle plate 2 is worked (see FIG. 1*c*).

Figure 3:
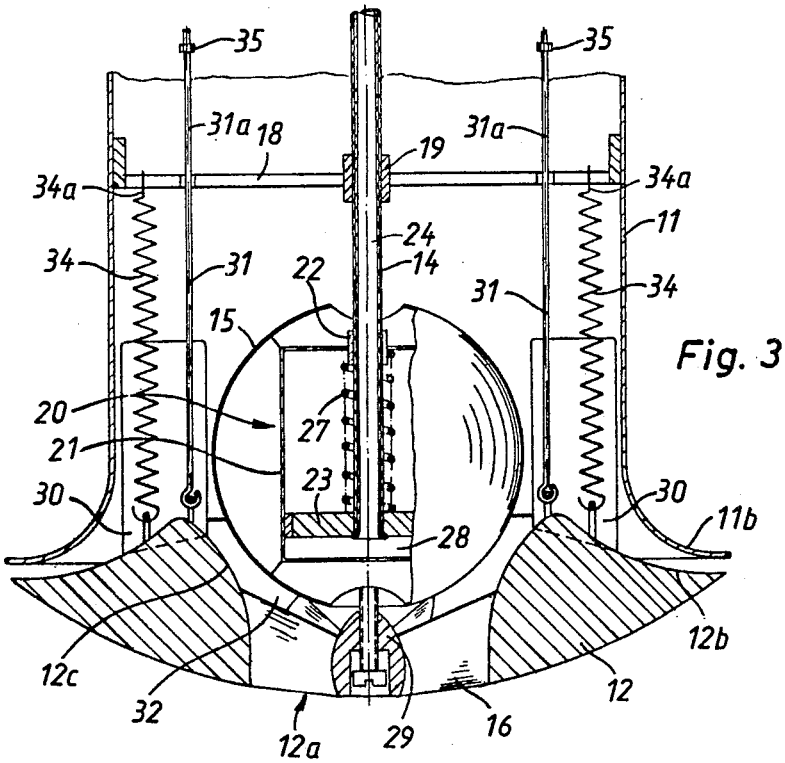
FIG. 3 is a view of a third working example of the invention in the form of an axial section, more specially viewing the driving system of the structure.

In the blowing outlet pipe 11 of FIG. 3, I have placed a cross-piece 18, which in a middle hole 19 is used for supporting the hollow push-rod 14 with a chance of adjustment for the air-powered servo-motor 20 in the inside of the hollow ball 15. The pressure cylinder 21 is supported, using a guide sleeve 22, on the push-rod 14. At the lower end of the push-rod, the sealing disc 23 is fixed. Between the inner floor of the pressure cylinder 21 and the sealing disc 23, the compression spring 27 is placed. A compressed air pipe 24 goes through the inside of the push-rod 14 and comes to an end at the lower end in the pressure space 28.

Bridges 30 are fixedly joined to nozzle plate 12. They are in fact joined with support rods 31, which at their other ends 31*a* are placed going through holes in cross-piece 18. Moving back springs 34 are joined with the valve plate 12. These springs 34 have their other ends 34*a* joined with cross-piece 18. The push-rods 14 have adjustment nuts 35 at ends 31*a*, the nuts being used for limiting opening of the radial space.

In opening 12*a* of the nozzle plate, twister blades 16 are fixedly positioned, which at the same time are used for supporting adjustment stop 29 for hollow ball 15.

When, under the control of a thermostat or an automatic control system (not figured), powering air goes through pipe 24 into pressure space 28, ball 15 is forced downwards against spring 27 till it comes up against stop 29. Between ball 15 and edge 12*c* of nozzle plate 2, there is only a narrow space or gap 32, whose breadth may undergo adjustment using stop 29. It may be decreased to zero.

Once further air is forced into the pressure space 28, spring 27 is forced together even more and ball 15, together with the nozzle plate 12 (the last-named against the moving back springs 34), is moved further downwards, so that the space between plate edge 12*b* and funnel edge 11*b* is opened. The size of the space produced may undergo adjustment with adjustment nuts 35. This position of the air outlet is more specially used for cooling purposes.

The invention, which is presented here using parts with radial symmetry, may furthermore take the form of structures with parts which are rectangular or polygonal in cross-section. The invention may furthermore be used in the case of a slot-like outlet and in this case the outwardly curved air distribution body will take the form of a cylinder.

The outwardly curved air distribution body may furthermore, in place of the ball used here, take an other form such as the form of a drop or a polyhedron. The important point is that the face, turned towards the nozzle plate, have the same form as the inner edge 2*c* used as the valve seat.

Figure 4:
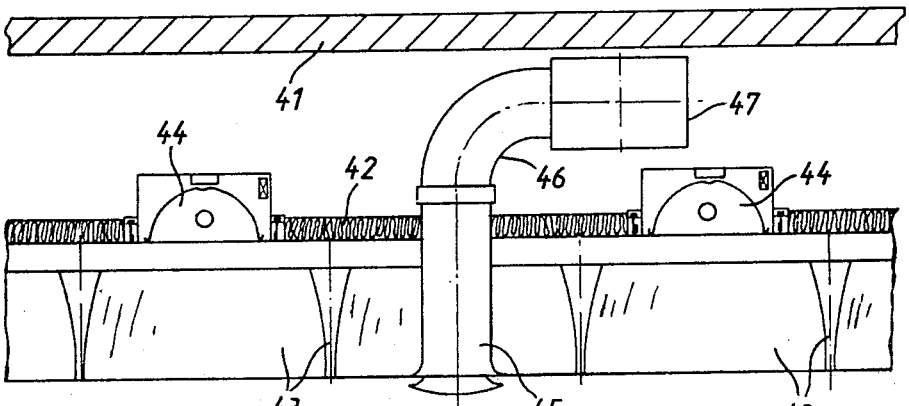
FIG. 4 is a diagrammatic view of an air outlet of the invention placed in a hanging ceiling which is not flat.

In FIG. 4 under a structural ceiling 41 a hanging acoustic ceiling 42 is placed. On mirror support moldings 43 are fixed for forming boxes. Under some boxes lighting units 44 are placed in the acoustic ceiling. In an inbetween box the air outlet 45 of the invention is placed running through acoustic ceiling 42. Air outlet 45 is joined by elbow 46 with air duct 47.

Figure 5:
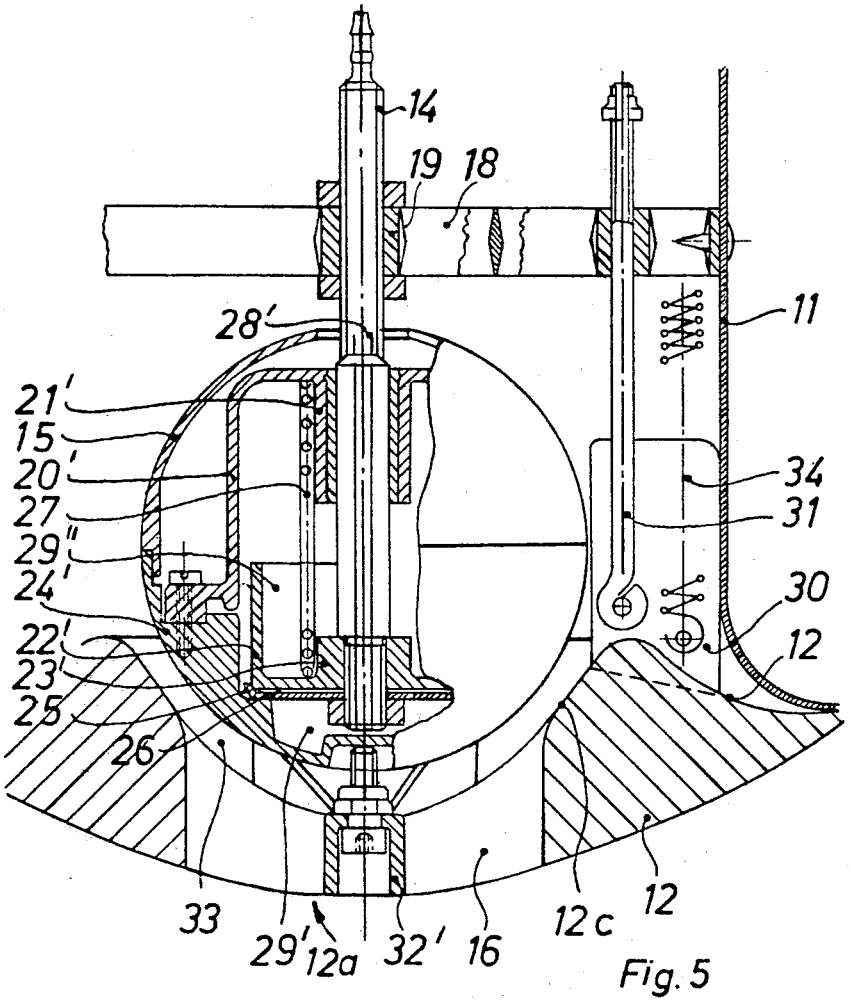
FIG. 5 is a view of a further working example of the invention like that to be seen in FIG. 3.

In FIG. 5 I have presented a further working example of the invention, which is generally like that seen in FIG. 3, although, however, the servo-motor is different. For making it simpler in FIG. 5, the same part numbers are used as in FIG. 3 for the same or like parts and such parts will not now be given any detailed account.

In the hollow ball 15 bell 20' is fixed to shoulder 24', and it is supported by way of a cylinder 21' running on the support rod 14. At the lower end of the support rod a further bell 22' is fixed with its cylinder 23'. Between bell 20' and shoulder 24' of the inner ball wall on the one hand, and the curved part of the bell 22' on the other hand and a gripping disc 25, membrane 26 is fixed, the membrane 26 being designed for rolling motion between the two outer walls of the bells. Between inner radial faces of the bells compression spring 27 is placed. Inlet air pipe 28' is placed running through the inside of the support rod 14 and has its lower end opening in the pressure space 29. Within the lower bell 22' there is a space 29'' for taking up the spring 27.

Once, under the control of a thermostat or of an automatic control system, powering air is run through the pipe 28' into pressure space 29', ball 15 is forced downwards till it comes up against a stop 32. Between ball 15 and edge 12*c* of the nozzle plate 12, there is only a narrow space or gap 33, able to be made narrower or wider by stop 32' and complete shut off, if desired.

Once further air is forced into the pressure space 29' the spring 27 is forced together and the ball 15 is moved further downwards together with the nozzle plate 12, which is moved against the force of the moving back springs 34. The outcome is that plate edge 12*c* is moved clear. Furthermore the edge of the connection 11 is opened making the outlet gap. This position of the outlet is more specially used for cooling purposes.

By using the membrane 26, which is responsible for making a seal between bells 22' and 20', greater tolerances may be used, so that the structure is low in price. Furthermore, loss of powering air is not possible, which might possibly have an undesired effect on the directions or distribution, of air motion in the system.

It is furthermore possible for the lower eye of the support rods 31 in the form of open hooks, so that, for servicing or adjustment operations, it is possible for the valve plate 12 to be moved out into its outermost position and then for the support rods 31 and the moving back springs 34 to be unjoined from the pins, with which they are normally fixed to the sheet metal parts or bridges 30. When the ball 15 has been moved out downwards into its outermost position, its top part, which is joined slippingly on the lower part, may be lifted clear. The fixing screws, with which the bell 20' is fixed on shoulder 24', may be undone and bell 20' may be moved downwards, so that the membrane is freed. The membrane, which is centered and fixed in position by way of a nut or disc, not specially numbered in the figure, at the lower end of the support rod 4, may, after undoing this nut or disc, be taken off and is exchanged for a new one. For this reason, servicing operations may readily be undertaken on the outlet and in this respect, more specially, by unscrewing the support rod 4, it is readily possible for the complete servo-motor to be taken out by screwing the support rod out of the middle hole 19 after undoing an inlet flexible air pipe (not figured) from the top end of the support rod 14 and, if necessary, a new servo-motor may be put in place.

We claim:

1. An air outlet comprising:

an axially elongated chamber having a housing formed with inlet and outlet ends, said outlet end being formed with a blowing mouth;

an outlet ring disposed in overlying relation over said mouth for shifting axially with respect thereto, the exterior periphery cooperating with said mouth to define a laterally outwardly opening outlet growing progressively larger as said ring is shifted along said axis away from said mouth, said ring being further formed with a central opening;

first mounting means movably mounting said ring from said housing for travel thereof away from and toward said mouth;

a valve body disposed in confronting relationship over said central opening and shiftable along said axis toward and away from said central opening to cooperate therewith in forming a progressively smaller or larger valve opening;

second mounting means movably mounting said valve body from said housing;

pusher means interposed between said ring and valve body and operative in response to a predetermined travel of said body toward said ring to engage said ring and shift it away from said mouth upon continued travel of said body in a direction toward said ring; and automatic means coupled with said valve body for sequentially shifting said valve body toward said ring to progressively restrict flow between said body and central opening and to then engage said ring and shift said ring progressively away from said mouth.

2. An air outlet as claimed in claim 1, characterised in that on a side of the valve plate facing the mouthpiece there is a valve seat and in that the valve body is able to be moved towards the blowing mouthpiece.

3. An air outlet as claimed in claim 1, characterised in that for the nozzle plate an adjustment unit is present for limiting the distance between the valve body and the nozzle plate.

4. An air outlet as claimed in claim 1, characterised in that for the valve body and the nozzle plate an adjustment unit is present for limiting the distance between them.

5. An air outlet as claimed in claim 1 characterised in that:

said valve body is formed to curve outwardly and away from said outlet ring.

6. An air outlet as claimed in claim 5, characterised in that the valve body is a ball.

7. An air outlet as claimed in claim 6, characterised in that the ball is a hollow ball.

8. An air outlet as claimed in claim 1 characterised in that:

said automatic means includes a servo-motor; and said automatic means drivingly couples said valve body with said servo-motor.

9. An air outlet as claimed in claim 8 characterised in that:

said automatic means couples said vale body and outlet ring to said servo-motor for closure and opening dependent on the relative position of one another.

10. An air outlet as claimed in claim 8 characterised in that:

said servo-motor includes a push-rod connected with said valve body means supporting said push rod from said servo-motor from said housing.

11. An air outlet as claimed in claim 6, characterised in that the servo-motor is placed inside the hollow ball.

12. An air outlet as claimed in claim 8, characterised in that the servo-motor has a driving magnet.

13. An air outlet as claimed in claim 8, characterised in that the servo motor has an electric motor.

14. An air outlet as claimed in claim 10, characterised in that the housing of the servo-motor at least partly takes the form of the valve body.

15. An air outlet as claimed in claim 1 characterised in that:

said pusher means includes a stop mounted on said ring and disposed in the axial path of said valve body.

16. An air outlet as claimed in claim 1 characterised in that:

said first mounting means includes means biasing said ring toward said mouthpiece.

17. An air outlet as claimed in claim 1 characterised in that:

said first mounting means includes a cross bar mounted in said housing and formed with at least one open ended axial guide hole;

a guide pin carrying said ring and projecting through said guide hole; and, return springs coupled between said cross bar and ring.

18. An air outlet as claimed in claim 1 characterised in that:

said ring includes directional vanes in said central opening for directing air flowing therethrough.

19. An air outlet as claimed in claim 15 characterised in that:

said stop means includes adjustment means for adjusting the distance said valve body is spaced from said ring when said body engages said stop.

* * * * *